United States Patent [19]

Johansson

[11] 4,259,938

[45] Apr. 7, 1981

[54] APPARATUS IN ELECTRONIC IGNITION SYSTEMS

[75] Inventor: Sven H. Johansson, Amal, Sweden

[73] Assignee: Aktiebolaget Svenska Electromagneter, Amal, Sweden

[21] Appl. No.: 44,655

[22] Filed: Jun. 1, 1979

[30] Foreign Application Priority Data

Jun. 2, 1978 [SE] Sweden ..... 7806521

[51] Int. Cl.[3] ..... F02P 1/00

[52] U.S. Cl. ..... 123/599; 123/601; 310/70 A

[58] Field of Search ..... 123/148 CC, 149 C; 310/70 R, 70 A

[56] References Cited

U.S. PATENT DOCUMENTS

| | | | |
|---|---|---|---|
| 3,623,467 | 11/1971 | Piteo | 123/148 CC |
| 3,630,185 | 12/1971 | Struber | 123/148 CC |
| 3,638,671 | 10/1974 | Farr | 123/148 CC |
| 3,911,886 | 10/1975 | Nagasawa | 123/148 CC |
| 3,937,200 | 2/1976 | Sleder et al. | 123/148 CC |
| 3,961,618 | 6/1976 | Swift | 123/148 CC |
| 4,038,951 | 8/1977 | Schweikart | 123/148 CC |
| 4,079,712 | 3/1978 | Nagasawa | 123/148 CC |
| 4,114,583 | 9/1978 | Sleder et al. | 123/148 CC |

FOREIGN PATENT DOCUMENTS

| | | | |
|---|---|---|---|
| 388459 | 10/1976 | Sweden | 123/148 |

*Primary Examiner*—Ronald B. Cox

*Attorney, Agent, or Firm*—Hill, Van Santen, Steadman, Chiara & Simpson

[57] ABSTRACT

The invention relates to an apparatus for providing capacitor charging and triggering in so-called electronic ignition systems comprising flywheel magnetos with a plurality of poles. The triggering pulses are arranged phase-shifted in time in relation to the charging pulses, whereby charging the capacitor in question is prevented after triggering initiating ignition. By arranging three windings, for example, connected in series on three adjacent magnetic core legs as capacitor charging pulse generating windings, and bridging over three adjacent ones with a rectifier with a polarity for passing through negative half pulses, a rather constant charging voltage is obtained for a wide range of the engine rpm.

11 Claims, 12 Drawing Figures

APPARATUS IN ELECTRONIC IGNITION SYSTEMS

BACKGROUND OF INVENTION

1. Field of Invention

The present invention refers to an apparatus in electronic ignition systems.

2. Prior Art

In conjunction with outboard motors for boats, for example, very high demands are made today for reliable engine function even at very low revolution rates. Electronic ignition systems, which have been found to be very advantageous in such engines because they enable moisture-proof enclosure, are usually equipped with a charging coil for charging a capacitor in the electronic ignition system. The charging coil gets its induction from permanent magnets mounted on the engine flywheel. It has been found, however, that at low revolution rates and even in conjunction with starting, the generated charging voltages have not been sufficient to provide the necessary spark in the associated spark plug. One means for overcoming this disadvantage is to arrange several, e.g. three, core legs with charging coils for coaction with the pertinent charging circuit, said coils each contributing to building up the necessary charge in the capacitor. In this way there is obtained very reliable idling revolution rates for the engine as well as good starting characteristics. However, with increasing r.p.m. there are direct problems with over-voltages in the charging circuit, and accompanying risks of destroying participating components such as rectifiers, thyristors and the like.

In a modern outboard motor, the ignition apparatus is generally built together with a generator part to provide lighting energy and possibly charging energy for a battery. In connection therewith there is a demand for a plurality of magnet poles along the circumference of the flywheel for coacting with a plurality of core legs carrying generator coils. This arrangement brings with it complications with regard to the triggering operation per se, since the triggering coil will be affected by a plurality of magnetic fields passing it. It is thus possible to get triggering at undesired places along a flywheel revolution. It is further a requirement that the trigger voltage be kept within reasonable values and at constant levels for large ranges of revolution rates. Swedish Pat. No. 7401667-6 is typical.

SUMMARY OF THE INVENTION

The present invention relates to a solution of said problems, where the advantages gained at low revolution rates by the multipole system are inter alia retained, but without obtaining injurious over-voltages at high revolution rates In the present case, three charging coils are preferably used, these being coupled in series and each mounted on a pole leg at a spacing corresponding to the pole spacing of coacting flywheel magnets. Across all series-coupled coils there is connected a protective diode, and in parallel with it a varistor circuit, a further protective diode being coupled across one or a pair of coils. By this arrangement there is achieved a uniform voltage over large ranges of r.p.m. Triggering is ensured by phase shifting in a mode disclosed in detail below.

The distinguishing features of the present invention are apparent from the following patent claims.

An embodiment of the invention will now be more closely described while referring to the accompanying drawings.

ON THE DRAWINGS

AS SHOWN ON THE DRAWINGS

Figure 1:
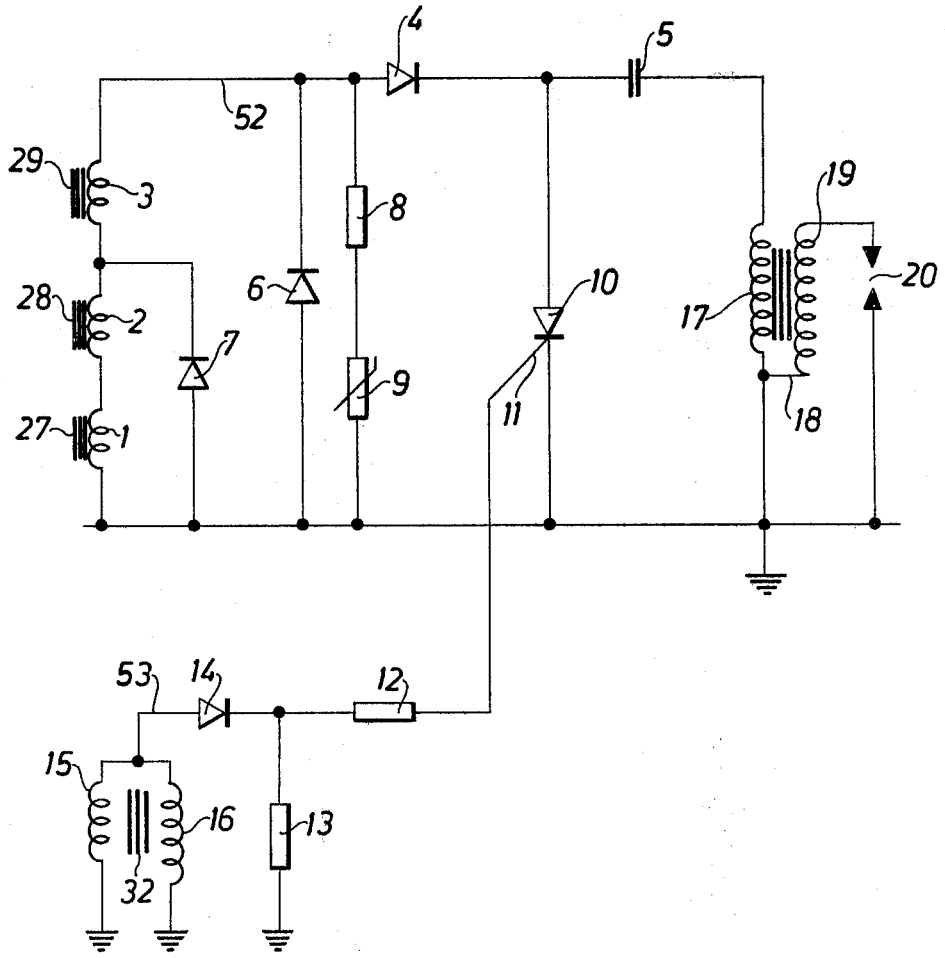
FIG. 1 is a circuit diagram of an embodiment in accordance with the invention.

The circuit in FIG. 1 comprises three charging coils 1, 2, 3 coupled in series with each other, for generating the necessary charging voltages and connected through a rectifier 4 to a capacitor 5. Across the coils 1, 2, 3 there is connected a protective diode 6 and across the coils 1, 2 a further diode 7. In parallel with the protective diode 6, a resistance 8 and a varistor 9 or the like is connected in series. Between ground and the connection between the rectifier 4 and the condensor 5 there is connected in a conventional mode a thyristor 10, to the control electrode 11 of which there is connected a voltage divider comprising of two resistances 12, 13 coupled in series. Between the resistances 12, 13 there is connected a rectifier 14 which is in communication with a trigger coil circuit having of two coils 15, 16 coupled in parallel. The capacitor 5 is connected in the way shown to the primary winding 17 of a transformer 18, the secondary winding 19 of which is connected to a spark plug 20.

Figure 2:
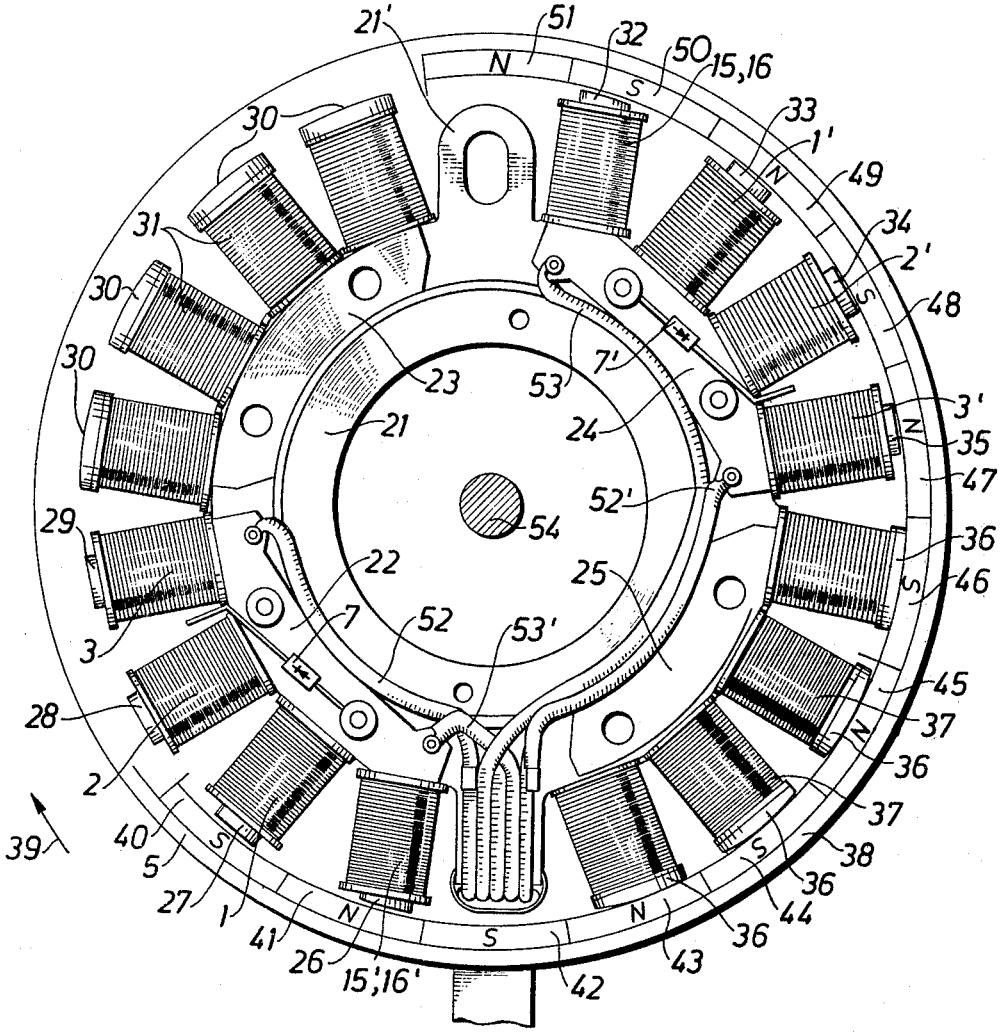
FIG. 2 is a practical arrangement of charging coils, triggering coils and generator coils applied to an outboard motor, for example.

The mechanical arrangement of the coils in FIG. 1 is shown in FIG. 2. Four cores, 22,23,24 and 25 of magnetically conductive material are arranged on an armature plate 21. The armature plate is provided with an eylet 21 for coaction with means, not shown, for turning the anchor plate to regulate the ignition setting. These cores each have four legs. The legs of the core 22 are denoted by 26, 27,28 and 29. The legs 27,28 and 29 carry the charging coils 1,2,3, respectively. The leg 26 carries a trigger coil circuit 15'/16', described below. The four legs and associated pole shoes 30 of the core 23 each carry a generator coil 31 and thus form a part of the electrical generator of the apparatus. Similar to the core 22, the core 24 comprises four legs 32,33,34 and 35. The leg 32 carries the trigger coils 15-16 associated with the previously described circuit. The legs 33,34 and 35 each carry, similar to the legs 27,28 and 29, a charging coil 1',2',3' in a second ignition circuit separate from the first one and feeding a second spark plug associated with a second engine cylinder, the trigger coils of the last mentioned second ignition circuit being the previously mentioned coils 15',16' carried by the leg 26. Similar to the core 23, the core 25 has four legs with pole shoes 36, said legs carrying further generator coils 37, which are coupled in a suitable way to the previously mentioned generator coils 31. Since the electric generator-coil arrangement does not form a part of the present invention, the circuit of the generator coil has not been shown in detail on the drawing.

A plurality of magnets are arranged on the inside of a flywheel 38 with their poles denoted N and S. About $\frac{2}{3}$ of the inside of the flywheel is provided with magnets while the remaining third does not have any magnets. In practice, counterweights must naturally be arranged on the flywheel to balance the magnets shown, although such means have not been shown in the present figures. It is assumed that the flywheel rotates in the direction of arrow 39. The first magnet in the direction of rotation has a south pole denoted by 40. The next magnet has a north pole denoted 41 and the subsequent magnet 42 once again has a south pole. The north and south poles of remaining magnets are denoted in sequence by 43–51. The legs 26 and 32 carrying the trigger coils do not project radially as the other legs do, but are inclined towards the direction of rotation. The reason for this arrangement is described below. As shown in FIG. 2 the diode 7 is connected across ground, i.e. the core 22 itself, and the connection between the coils 2 and 3. A wire 52 goes from the pole 3 and to the diode 4 shown in FIG. 1, as well as to the anode of the diode 6 and to resistor 8. A similar wire 52' goes from the coil 3' to its ignition circuit. Between ground, i.e. the core 24, and the connecting point between the coils 2' and 3' there is also connected a diode 7'. From the mutually connected trigger coils 15,16 there is a wire 53 leading to the diode 14 in FIG. 1. A similar wire goes from the trigger coils 15'/16' and is denoted 53'. Since it is a question here of two identical ignition installations, only the function of the first ignition installation is described below. To complete the construction, a shaft 54 carrying the flywheel 38 is shown at the center of the apparatus.

Figure 3:
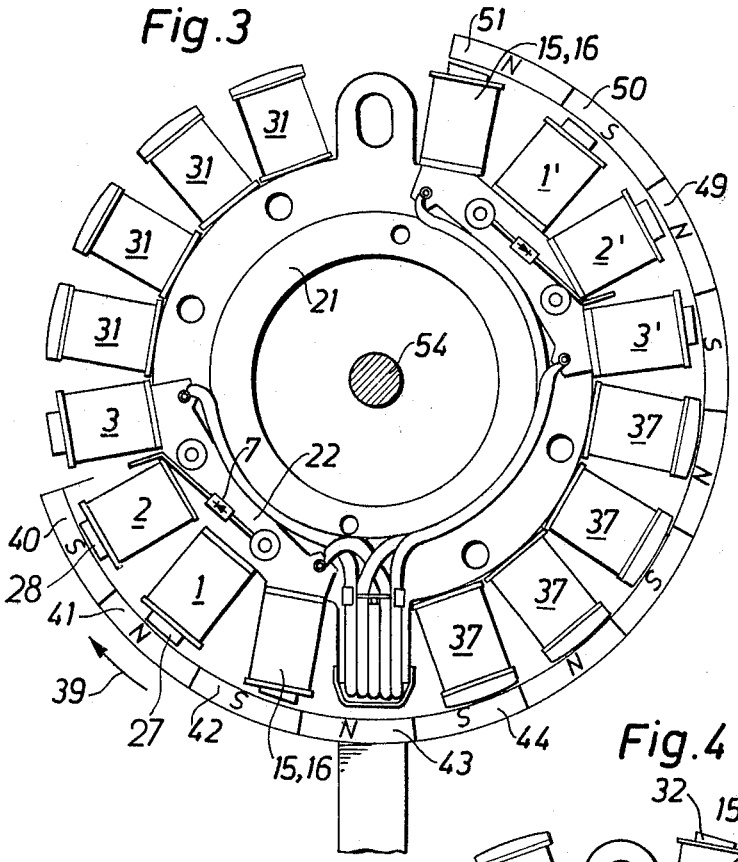
FIGS. 3, 4 and 5 illustrate different positions of a flywheel.
Figure 4:
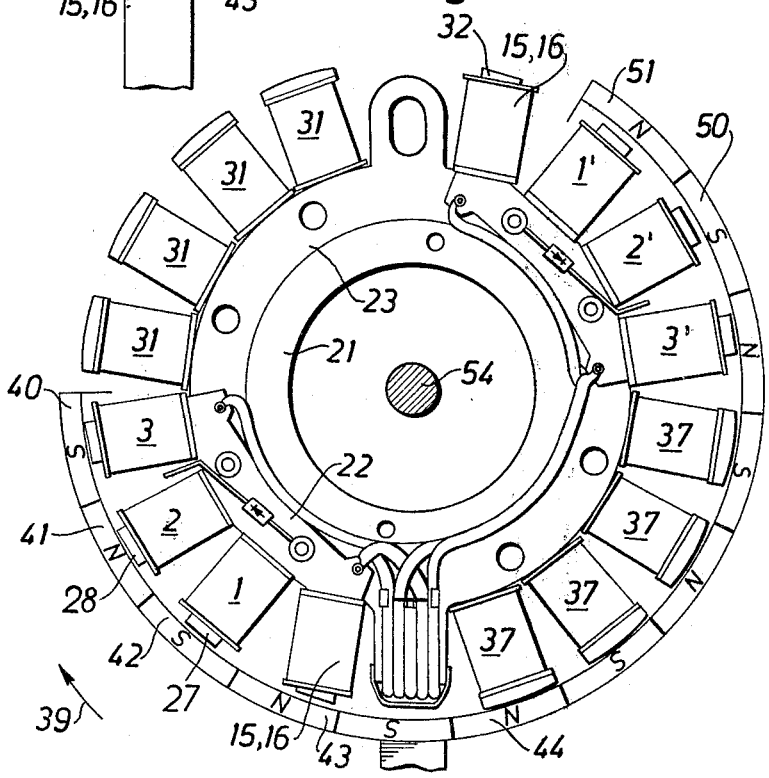
Figure 5:
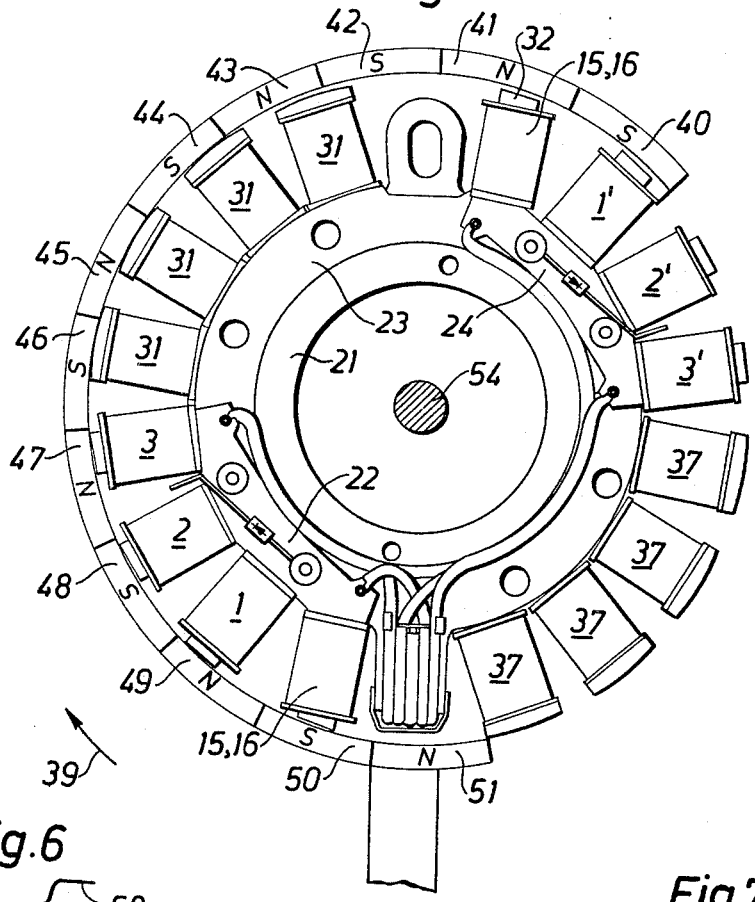

The apparatus functions in the following way. It is assumed that the starting position is as shown in FIG. 2, i.e. the magnet 40 coacts with the leg 27 and the magnet 41 with the leg 26, thus forming a closed magnetic circuit through the pertinent part of the core 22. The winding direction of the coil is such that a so called negative initial pulse occurs for the generated induction. This pulse is of comparatively minor size, and with regard to the direction of the charging diode 4, the latter will block. If now the flywheel turns in the direction of the arrow 39, so that the magnet 40 comes into coaction with the leg 28, as shown in FIG. 3, and the magnet 41 with the leg 27, a maximum flux change will occur in the leg 27 so that a voltage pulse in a positive direction is induced in the coil 1, i.e. in such a direction that charging current will now flow through the diode 4 via the two other charging coils 2 and 3. The winding direction for the coil 2 is the reverse of that in coil 1. There thus occurs in the coil 2, due to the coaction of the leg 28 with the magnet 40, a positive initial pulse which thus has the same sign as the pulse in the coil 1. The pulse in the coil 1 thus adds itself to the last mentioned initial pulse. When, as shown in FIG. 4, the magnets have moved a further step so that the magnet 41 coacts with the leg 28, full flux change in a negative direction will have been accomplished by the effect of the magnet 41 on the leg 28, a negative pulse thus occurring in the coil 3, which has the same winding direction as the coil 1. A counter flux change has meanwhile taken place in the first leg 27, so that an induction in a negative direction has occurred in the coil 1 simultaneously with negative induction in the coil 2.

When the flywheel continues to turn in the direction of the arrow 39, full flux change will occur in all three legs, as is clearly apparent, and sinusoidal oscillations will occur simultaneously in the coils 1,2 and 3. After feeding these sinusoidal oscillations to the diode 4 there will occur pulses during the positive half periods, and these can be supplied to the capacitor 5 for charging it.

Figure 6:
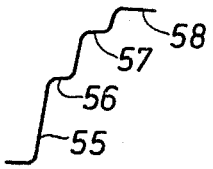
FIGS. 6 and 7 are graphs of the charging sequence for different speeds.

As is shown by the graph 55 in FIG. 6, there is an increment to the charge in the capacitor 5 giving different charging levels for each flux change. At the relatively low rate of revolutions in question here, there is obtained a charging level 56 for the first maximum flux reverse in the coil in question, for the next flux reverse a charging level 57, and a subsequent flux change a charging level 58, constituting the full charge of the capacitor. Further flux reverses in the legs concerned will naturally generate voltage pulses exceeding the maximum permitted charging voltage value. These excessive voltage values are grounded by in the varistor circuit 8,9.

Figure 7:
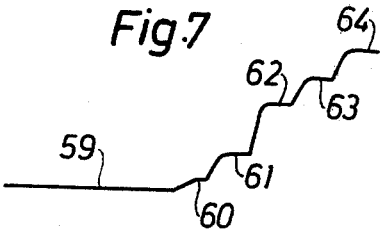

For very high flywheel revolution rates, the time for induction of charging pulses will naturally be shorter even if the induced voltage can be instantaneously higher than at low r.p.m. FIG. 7 illustrates how the charging sequence will be distributed for higher revolution rates, e.g. maximum engine r.p.m. In the graph 59 there is thus obtained a plurality of charging levels in time with the induced voltages, these charging levels being presented by horizontal graph portions 60,61,62,63 and 64. The level 64 represents full charge.

Figure 8:
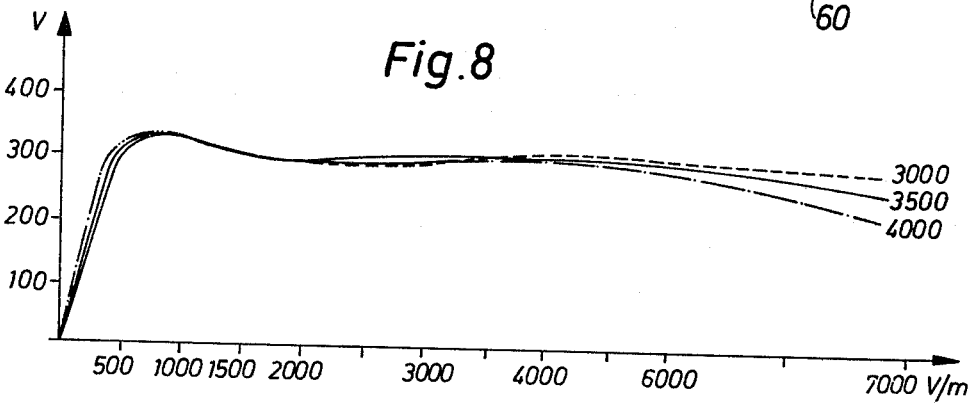
FIG. 8 shows the charging voltage as a function of the revolution rate.
Figure 9:
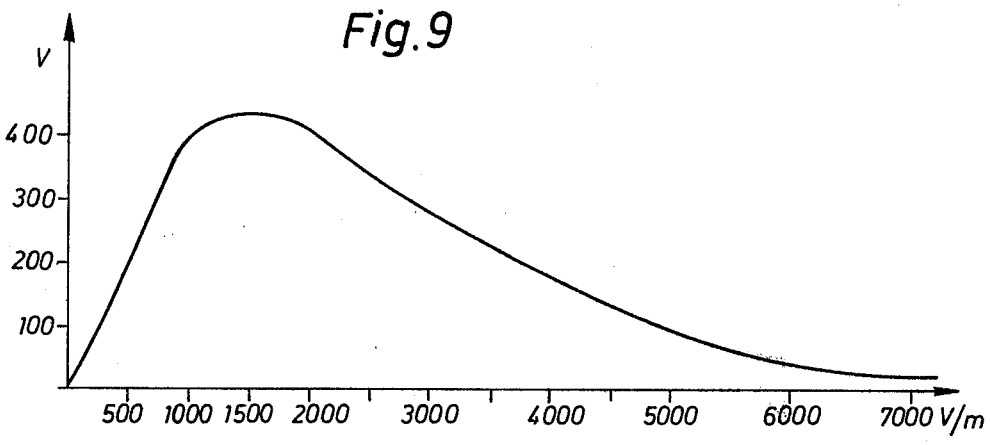
FIG. 9 shows the charging voltage as a function of the revolution rate under deviating conditions.

From the relationship shown in FIG. 2, and subsequent rotational positions for the magnets there is as mentioned a positive pulse at the first maximum flux change in the coil 1, this pulse going via coils 2 and 3 to the diode 4. In the coils 2 and 3, and this is especially applicable to the coil 3 which is free from magnetic flux, there occurs a choke action which thus dampens the induced charging current from the coil 1. This choking action will naturally be more noticable the higher the speed the magnets rotate at, i.e. the damping action increases with increased pulse frequency. This is, inter alia, an explanation of the low charging values obtained at the beginning of graph 59 in FIG. 7. During operation, there naturally occur considerable negative half periods, and the diode 4 must naturally be protected from back voltages which are too large. For this purpose, there is primarily arranged a diode 6 across all three coils 1,2,3. However, it is necessary for the circuit function to divide the voltage drop so that negative half periods coming from the coils 1 and 2 are grounded separately by a diode, namely the diode 7. Several advantages are obtained by the current distribution occurring during the negative half periods. The circuit formed by the coils 1 and 2 will be completely short-circuited by the diode 7, a large load thereby appearing on the coils 1 and 2. During the negative half periods, the current circuit formed by the coils 1,2 and the diode 7 constitutes an impedance for the coil 3 and the diode 6, whereby the current through the diode 6 will be restricted. The result of this is that at the juncture to the positive half period, the coil 3 will start from a voltage platform built up from the first mentioned circuit, voltage maintenance thus being built up for the whole circuit even at high engine revolution rates. This result is apparent from FIG. 8, which illustrates the charging voltage as a function of the revolution rate of the flywheel magneto. In a practical case, it is assumed that the coils 1 and 2 are each wound with 5000 turns, and that the coil 3 is wound with 3500 turns. It will be seen from the full line curve in FIG. 8 that the 3500 turns for the coil 3 at an r.p.m. of over 6000 gives an inconsiderable lowering of the charging voltage in relation to what is attained at 500 or 1000 r.p.m., for example. If the number of turns on the coil 3 is increased to 4000, a considerable reduction of the voltage in the high r.p.m. range is obtained, while if there are only 3000 turns on the coil 3, a substantially straight curve is obtained in the higher r.p.m. range. It is the dimensioning of the coil 3 in the circuit shown which controls the voltage curve for charging. If the diode 7 were to be excluded from the circuit shown, the voltage curve for the charge would be that shown in FIG. 9. There is immediately a notable lowering of the charging voltage towards higher r.p.m. The circuitry and function of the diode 7 is thus of vital importance. By the circuitry shown, a desired function has consequently been provided solely by a circuitry combination with passive components, which is advantageous from the point of view of construction.

Figure 10:
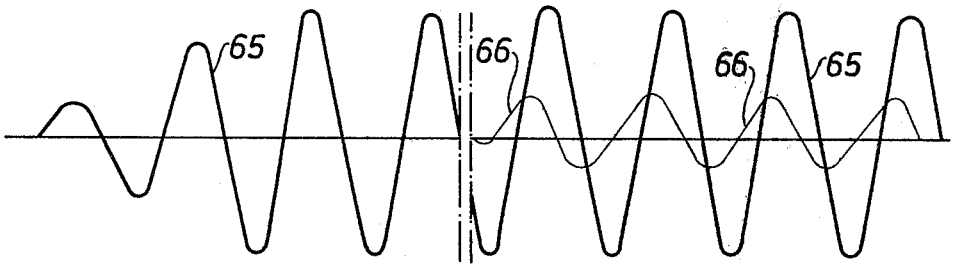
FIG. 10 illustrates the induction sequence in the charging circuit.

As previously pointed out, voltage pulses continue to be generated in the coils 1, 2 and 3 when the flywheel magnets are rotated past the legs 27,28,29, but after a full charge has been obtained, they have no effect on the charge state. The first magnet 40 now approaches the leg 32, carrying the trigger coils 15,16. During its previous movement past the pole shoes 30 and coils 31 the necessary generator voltage in these have been generated by the flux change occurring. When the magnet 40 comes into coaction with the leg 32 there occurs a negative initial pulse for triggering, due to the existing winding direction. When the magnet 41 then comes into coaction with the leg 32, full flux change occurs, so that a positive pulse is built up, which is supplied to the control electrode 11 on the thyristor 10 through the rectifier 14 via the voltage divider 12,13. Two curves 65 and 66 are shown in FIG. 10, the extent of the curves being interrupted by the vertical chain-dotted lines, so that non-essential portions of the curves are excluded. The curves thus illustrate open circuit voltage generation in the charging and trigger coils respectively. It is clearly apparent here how the curve 66 is somewhat phase-shifted to lead the curve 65, which is because the associated leg 32 is inclined towards the direction of movement 39 of the magnets. The phase shift thereby occurring is of importance for the spark sequence function as such.

Figure 11:
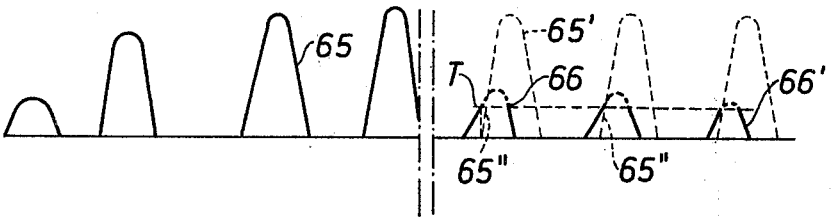
FIG. 11 illustrates charging and trigger pulses.

FIG. 11 only shows the positive half-waves of the curves in FIG. 10. The positive half periods of the curve 65 are denoted by 65' and the half periods of the curve 66 are denoted by 66'. For the first positive half period of the curve 66 and for trigger level T, i.e. the instant at which triggering is to take place, the charge already existing in the capacitor will completely discharge and an ignition spark occur. However, simultaneously with this discharge and due to the induction in the coils 1,2 and 3 which is still in progress, there will be an attempt to rebuild the charging voltage, which is denoted by the curve portin 65''. As is clearly apparent from the curves to the right of the dividing line in FIG. 11, charging will be effectively eliminated by the growing and phase-shifted trigger pulse 66'. When the positive going curve 65'' passes the zero level, the trigger curve 66' with its advanced phase shift has reached the trigger level, and the thyristor opens so that the charging pulse is now led away through the thyristor, although this pulse would have caused charging the capacitor 5 if the thyristor 10 had been closed. This is repeated in continuation, and each tendency for generating a charge in the capacitor 5 is prevented by the phase shift of the trigger pulses. Even when the last magnet 51 has gone past the coil 3, formation of trigger pulses in the coils 15,16 still continues, which means that when the last magnet 51 has also left the trigger coil 15,16, the capacitor 5 is definitely free from charge. As is apparent from FIG. 3, simultaneously as full flux change occurs in coil 1 triggering takes place due to the last flux change being now generated in the trigger leg 32 as the magnet 51 passes. Thus the charging pulse first generated in the coil 1 is always shunted off. The reason for this is that the first flux change never reaches up to the force provided by subsequent changes due to physical conditions, and also that it is desired to keep the time the capacitor is charged as short as possible to prevent degeneration. In practice it can be suitable to arrange more magnets than are shown here, whereby capacitor charging occurs only under one, or a few heavy charging pulses. The trigger legs 26 and 32 experience the effect of magnetic fields occurring between the legs of the generator coils and said trigger leg. There is often a load at the generator coils, and this means that the magnetic flux which is built up in the trigger leg will be evened out to a certain extent, whereby building up a relatively disturbance-free trigger function curve can be achieved. Connection to adjacent magnet circuits 33,34,35 also contribute to evening-out the trigger pulses. After the initial stage of the triggering operation, the trigger coils 15,16 are loaded by the resistance 13, whereby smooth and balanced trigger control is obtained.

Figure 12:
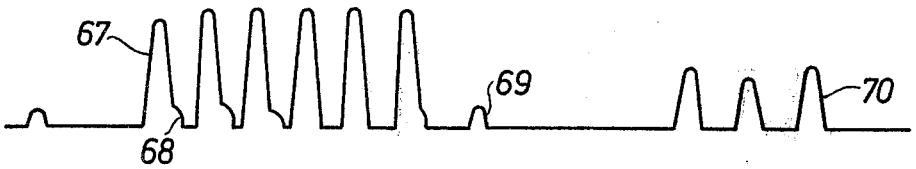
FIG. 12 illustrates different trigger pulse conditions.

The trigger circuit has two coils 15 and 16 with greatly different numbers of winding turns. The advantage of this arrangement is that very uniform trigger voltage is obtained over a large rpm range simultaneously as distinct trigger pulses are achieved. The lefthand side of FIG. 12 illustrates the pulse forms obtained if a single coil is used to provide trigger pulses. At their lower terminating portions these trigger pulses 67 have unevenesses 68 in the form of jumps in the curves. These unevenesses cause indistinct triggering, especially at high rpm, and in spite of measures in respect of loading of the appropriate magnetic circuits, the desired clean sequences are not obtained. Furthermore, intermediate pulses 69 occur. In this regard, consideration must be given to the fact that so-called magnetic turbulence, i.e. flux wandering which is not restricted to desired flux paths, is caused here due to the many flux paths. By arranging two coils 15,16 in parallel, with different numbers of turns in their windings, a result is obtained at low rpm in which the coil with the larger number of turns, in this case the coil 16, is responsible for generating the necessary trigger voltages, but is heavily loaded by the coil with the smaller number of turns. In the higher rpm range, the coil with the smaller number of turns will maintain the necessary voltage for generating trigger pulses, but because of its lower number of turns it will control the voltage for the other coil 16. The frequency will naturally be greater for higher rpm, the inner losses in the coil 16, with the larger number of turns, will contribute to the desired voltage maintenance. The right-hand portion of FIG. 12 illustrate the trigger pulses 70 obtained.

An ignition circuit (not shown) having the charging voltage coils 1',2' and 3' with associated trigger coils 15' and 16' functions in a corresponding manner to that described in conjunction with the circuit pertaining to the coils 1,2,3. In the present embodiment, it is suitable to distribute the magnets in such a way that about two-thirds of the revolution is covered. An arrangement covering the whole of the revolution would not function, since constant triggering of charge voltages would occur, unless a magnet were reversed, for example, whereby a magnetic gap would occur. Having solely two magnet segments facing each other would naturally function from the ignition point of view, but with regard to the generator part, it is less suitable, since there would be an uneven voltage build-up in the generator circuit and energy yield would also be too poor. Several variations can naturally be conceived within the scope of the invention. The number of charging coils and legs which have been illustrated here is naturally only to be regarded as an example and is taken directly from a practical embodiment.

What is claimed is:

1. An ignition system for an internal combustion engine having a flywheel and a spark plug, comprising:

(a) a plurality of magnets for being carried on the flywheel and having poles of alternating polarity arranged in uniform spacing;

(b) a first magnetic core having legs arranged in said uniform spacing to coact with said magnets;

(c) charging coils on said legs;

(d) a capacitor arranged to be discharged through the spark plug;

(e) a charging circuit including the windings of said charging coils, and connected to said capacitor;

(f) a second separate magnetic core having a leg for coacting with said magnets, said leg being remote from the nearest of said first-named legs by a plurality of pole spacings;

(g) said legs of said first magnetic core having a mutual spacing such that they can be simultaneously aligned with said poles while the leg of said second magnetic core is displaced from a position of alignment with an adjacent pole;

(h) said legs of said first magnetic core being radially directed towards the rotational axis of the flywheel, and said leg of said second magnetic core being inclined away from said axis towards the direction of rotation of the flywheel; and (i) a trigger coil on the leg of said second core and having a winding forming part of a trigger circuit connected to discharge said capacitor, the phase position of pulses induced in said trigger coil being ahead of pulses induced in said charging coils.

2. An ignition system for an internal combustion engine having a flywheel and a spark plug, comprising:

(a) a plurality of magnets for being carried on the flywheel and having poles of alternating polarity arranged in a uniform spacing;

(b) a first magnetic core having legs arranged in said uniform spacing to coact with said magnets;

(c) charging coils on said legs;

(d) a capacitor arranged to be discharged through the spark plug;

(e) a charging circuit including the windings of said charging coils, and connected to said capacitor;

(f) a second separate magnetic core having a leg for coacting with said magnets, said leg being remote from the nearest of said first-named legs by a plurality of pole spacings; and (g) a trigger coil on the leg of said second core and having a winding forming part of a trigger circuit connected to discharge said capacitor, the phase position of pulses induced in said trigger coil being ahead of pulses induced in said charging coils, said trigger coil being so angularly spaced from said charging coils that at least one of the initial capacitor charging pulses is short circuited by the trigger circuit.

3. An ignition system for an internal combustion engine having a flywheel and a spark plug, comprising:

(a) a plurality of magnets for being carried on the flywheel and having poles of alternating polarity arranged in a uniform spacing;

(b) a first magnetic core having legs arranged in said uniform spacing to coact with said magnets;

(c) charging coils on said legs;

(d) a capacitor arranged to be discharged through the spark plug;

(e) a charging circuit including the windings of said charging coils, and connected to said capacitor;

(f) at least two adjacent ones of said legs on said first magnetic core carrying two of said charging coils connected in series;

(g) a rectifier bridging two of said charging coils and polarized to conduct pulses having a polarity opposite to capacitor charging pulses, whereby voltage control is provided for all said charging coils;

(h) a varistor and a further rectifier connected in parallel across all said charging coils, said further rectifier being polarized to conduct pulses opposite to capacitor charging pulses;

(i) a second separate magnetic core having a leg for coacting with said magnets, said leg being remote from the nearest of said first-named legs by a plurality of pole spacings; and (j) a trigger coil on the leg of said second core and having a winding forming part of a trigger circuit connected to discharge said capacitor, the phase position of pulses induced in said trigger coil being ahead of pulses induced in said charging coils.

4. An ignition system for an internal combustion engine having a flywheel and a spark plug, comprising:

(a) a plurality of magnets for being carried on the flywheel and having poles of alternating polarity arranged in a uniform spacing;

(b) a first magnetic core having legs arranged in said uniform spacing to coact with said magnets;

(c) three charging coils on said legs;

(d) a capacitor arranged to be discharged through the spark plug;

(e) a charging circuit including the windings of said charging coils, and connected to said capacitor;

(f) at least two adjacent ones of said legs on said first magnetic core carrying two of said charging coils connected in series, two of the adjacent ones of said charging coils having substantially the same number of winding turns, the third of said charging coils having a different number of turns, whereby said different number of turns may be selected to suit the speed range of the engine;

(g) a rectifier bridging two of said charging coils and polarized to conduct pulses having a polarity opposite to capacitor charging pulses, whereby voltage control is provided for all said charging coils, (h) a second separate magnetic core having a leg for coacting with said magnets, said leg being remote from the nearest of said first-named legs by a plurality of pole spacings; and (i) a trigger coil on the leg of said second core and having a winding forming part of a trigger circuit connected to discharge said capacitor, the phase position of pulses induced in said trigger coil being ahead of pulses induced in said charging coils.

5. An ignition system for an internal combustion engine having a flywheel and a spark plug, comprising:

(a) a plurality of magnets for being carried on the flywheel and having poles of alternating polarity arranged in a uniform spacing;

(b) a first magnetic core having legs arranged in said uniform spacing to coact with said magnets;

(c) charging coils on said legs;

(d) a charging circuit including the windings of said charging coils;

(e) a capacitor connected to said charging circuit and arranged to be discharged through the spark plug;

(f) a second magnetic core having a leg for coacting with the same said magnets, said leg being remote from the nearest of said first-named legs, and being displaced a part of a pole spacing in the direction of magnet rotation;

(g) a trigger coil on the leg of said second core and having a winding forming part of a trigger circuit connected to discharge said capacitor, the pulses induced in said trigger coil thereby being ahead in phase of pulses induced in said charging coils and of the same frequency, whereby charging pulses and trigger pulses are generated simultaneously during a portion of a flywheel revolution; and (h) the amount which said leg is displaced being that to advance the phase of the trigger pulses so they occur as the charging pulses rise from zero or shortly thereafter.

6. An ignition system for an internal combustion engine having a flywheel and a spark plug, comprising:

(a) a series of magnets for being carried on the flywheel and having a series of poles of alternating polarity, including a plurality of poles of like polarity, arranged in a uniform spacing;

(b) a first magnetic core having legs arranged in said uniform spacing to coact with said magnets;

(c) charging coils on said legs;

(d) a capacitor arranged to be discharged through the spark plug;

(e) a charging circuit including the windings of said charging coils, and connected to said capacitor;

(f) a second separate magnetic core having a fixed leg for coacting with all of the same said magnets, said leg being remote from the nearest of said first-named legs by a plurality of pole spacings;

(g) a trigger coil on the leg of said second core and having a winding forming part of a trigger circuit connected to discharge said capacitor, the position of said fixed leg being such that the phase position of pulses induced in said trigger coil will be ahead of pulses induced in said charging coils.

7. An ignition system according to claim 6, said legs of said first magnetic core having a mutual spacing such that they can be simultaneously aligned with said poles while the leg of said second magnetic core is displaced from a position of functional alignment with an adjacent one of said same magnets.

8. An ignition system according to claim 1, the angle in which said leg is inclined being about 10 degrees.

9. An ignition system according to claim 6, said fixed leg position being such that the raising portion of the trigger pulse substantially reaches the trigger potential just as a charging pulse begins to build up.

10. An ignition system according to claim 6, said trigger coil being angularly spaced from said first magnetic core along the rotational path of the flywheel at a spacing of about six of said magnets.

11. An ignition system according to claim 6, said magnet poles extending along a continuous portion, less than all, of the circumference, said portion being about two-thirds of the circumference of the flywheel.

* * * * *